US007935012B2

(12) United States Patent
Lee

(10) Patent No.: US 7,935,012 B2
(45) Date of Patent: May 3, 2011

(54) ARROW FOR HUNTING

(76) Inventor: Young Ki Lee, Busan (KR)

( * ) Notice: Subject to any disclaimer, the term of this patent is extended or adjusted under 35 U.S.C. 154(b) by 386 days.

(21) Appl. No.: 12/244,557

(22) Filed: Oct. 2, 2008

(65) Prior Publication Data

US 2009/0270207 A1 Oct. 29, 2009

(30) Foreign Application Priority Data

Apr. 25, 2008 (KR) ..... 10-2008-0039038

(51) Int. Cl.
*F42B 6/08* (2006.01)

(52) U.S. Cl. ..... 473/578; 473/582; 473/583

(58) Field of Classification Search ..... 473/578, 473/582, 583

See application file for complete search history.

(56) References Cited

U.S. PATENT DOCUMENTS 3,756,601 A * 9/1973 Frey et al. ..... 473/582
6,739,992 B2 * 5/2004 Kummerle ..... 473/582
6,966,856 B1 * 11/2005 Hajek ..... 473/583
7,207,908 B1 * 4/2007 Gizowski ..... 473/583
2006/0030438 A1 * 2/2006 Hajek ..... 473/583
2006/0084535 A1 * 4/2006 Kuhn ..... 473/583
2010/0009789 A1 * 1/2010 Byrne ..... 473/584

* cited by examiner

*Primary Examiner* — John Ricci

(74) *Attorney, Agent, or Firm* — John K. Park; Park Law Firm

(57) ABSTRACT

The present invention relates to an arrow for hunting that includes: an arrow shaft member of a predetermined length having a recess part formed on one end thereof so as to insert a bowstring of a bow thereinto and a spiral insertion protruding part formed at the inside on the other end thereof; a plurality of wing members mounted near the recess part of the arrow shaft member in such a manner as to be spaced apart by a predetermined distance from each other along the outer periphery of the arrow shaft member; and an arrowhead having a pointed shape at the end thereof in such a manner as to be adapted to be inserted into the body of the hunting target and a spiral protruding part formed along the outer periphery of the end portion protruded from the other end thereof.

6 Claims, 6 Drawing Sheets

ARROW FOR HUNTING

BACKGROUND OF THE INVENTION

1. Field of the Invention

The present invention relates to an arrow, and more particularly, to an arrow for hunting which is adapted to hit a hunting target, thereby making the hit target bleed much, such that the hit target is not moved away and easily captured.

2. Background of the Related Art

Generally, hunting instruments for capturing animals include guns and arrows as widely used. Especially, since the guns are not allowed for hunting in some areas in U.S.A., just arrows are allowed for hunting.

The arrow for hunting has an arrowhead mounted on the front end thereof, the arrowhead being very pointed at the end portion thereof. At the moment where the arrow for hunting is moved from a bowstring of a bow and hits the body of a hunting target, the pointed end of the arrowhead cuts into the body of the hunting target to cause the arrow for hunting to get stuck into the body of the hunting target, such that the hit target bleeds much and is easily captured. In some cases, if the flying speed of the arrow is relatively high, the arrow is passed through the body of the hunting target.

However, conventional hunting arrows do not make the hunting target bleed much, such that the hit target may be moved away from the place where it hits by the arrow, which undesirably needs much time and endeavors for capturing the hit target.

In other words, after the hunting target is hit by the hunting arrow, it should bleed much, such that the hit target cannot be moved away and can be easily captured. By the way, the conventional arrows for hunting are configured wherein even when they hit a hunting target, they fail to make the hit target bleed much, such that the hit target is moved away, while bleeding, thereby undesirably needing much time and endeavors for capturing the hit target.

SUMMARY OF THE INVENTION

Accordingly, the present invention has been made in view of the above-mentioned problems occurring in the prior art, and it is an object of the present invention to provide an arrow for hunting that is configured wherein at the moment where the arrow hits a body of a hunting target, an arrowhead rotatably enters the body of the hunting target, thereby making the hit target bleed much, such that the hit target is not moved away and easily captured.

To accomplish the above object, according to one aspect of the present invention, there is provided an arrow for hunting including: an arrow shaft member of a predetermined length having a recess part formed on one end thereof so as to insert a bowstring of a bow thereinto and an arrow shaft screw part formed at the inside on the other end thereof, the arrow shaft screw part having a screw thread formed thereon; a plurality of wing members mounted near the recess part of the arrow shaft member in such a manner as to be spaced apart by a predetermined distance from each other along the outer periphery of the arrow shaft member, each wing member being formed of a thin plate protruded from the surface of the arrow shaft member; a connecting member adapted to be coupled to the arrow shaft member and having a round plate part, a connecting screw part protruded from the round plate part and having a screw thread formed along the outer periphery thereof in such a manner as to be screw-coupled to the arrow shaft screw part, and a spiral protruding part formed protrudedly from the round plate part in an opposite direction to the connecting screw part and having a plurality of spiral grooves formed along the outer periphery thereof at predetermined intervals; and an arrowhead adapted to be coupled to the connecting member in the opposite direction to the arrow shaft member coupled to the connecting member and having a pointed shape at the end thereof in such a manner as to be adapted to be inserted into the body of the hunting target and a plurality of insertion protrusions formed along the inner periphery of the end portion thereof in such a manner as to be inserted into the plurality of spiral grooves.

To accomplish the above object, according to another aspect of the present invention, there is provided an arrow for hunting including: an arrow shaft member of a predetermined length having a recess part formed on one end thereof so as to insert a bowstring of a bow thereinto and a spiral insertion protruding part formed at the inside on the other end thereof; a plurality of wing members mounted near the recess part of the arrow shaft member in such a manner as to be spaced apart by a predetermined distance from each other along the outer periphery of the arrow shaft member, each wing member being formed of a thin plate protruded from the surface of the arrow shaft member; and an arrowhead having a pointed shape at the end thereof in such a manner as to be adapted to be inserted into the body of the hunting target and a spiral protruding part formed along the outer periphery of the end portion protruded from the other end thereof, the spiral protruding part having a plurality of spiral grooves formed thereon at predetermined intervals in such a manner as to be inserted into the spiral insertion protruding part of the arrow shaft member, thereby being coupled to the arrow shaft member.

According to the present invention, preferably, the lengthwise center line in each wing member is formed slantly with respect to the lengthwise center line in the arrow shaft member, such that while the arrow shaft member is flying, each wing member receives air resistance to rotatably fly the arrow shaft member.

According to the present invention, further, the spiral directions of the plurality of spiral grooves are formed such that the arrowhead is rotated in the same direction as the rotating direction of the arrow shaft member.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on an arrow for hunting according to a first embodiment of the present invention will be given with reference to the attached drawings.

Figure 1:
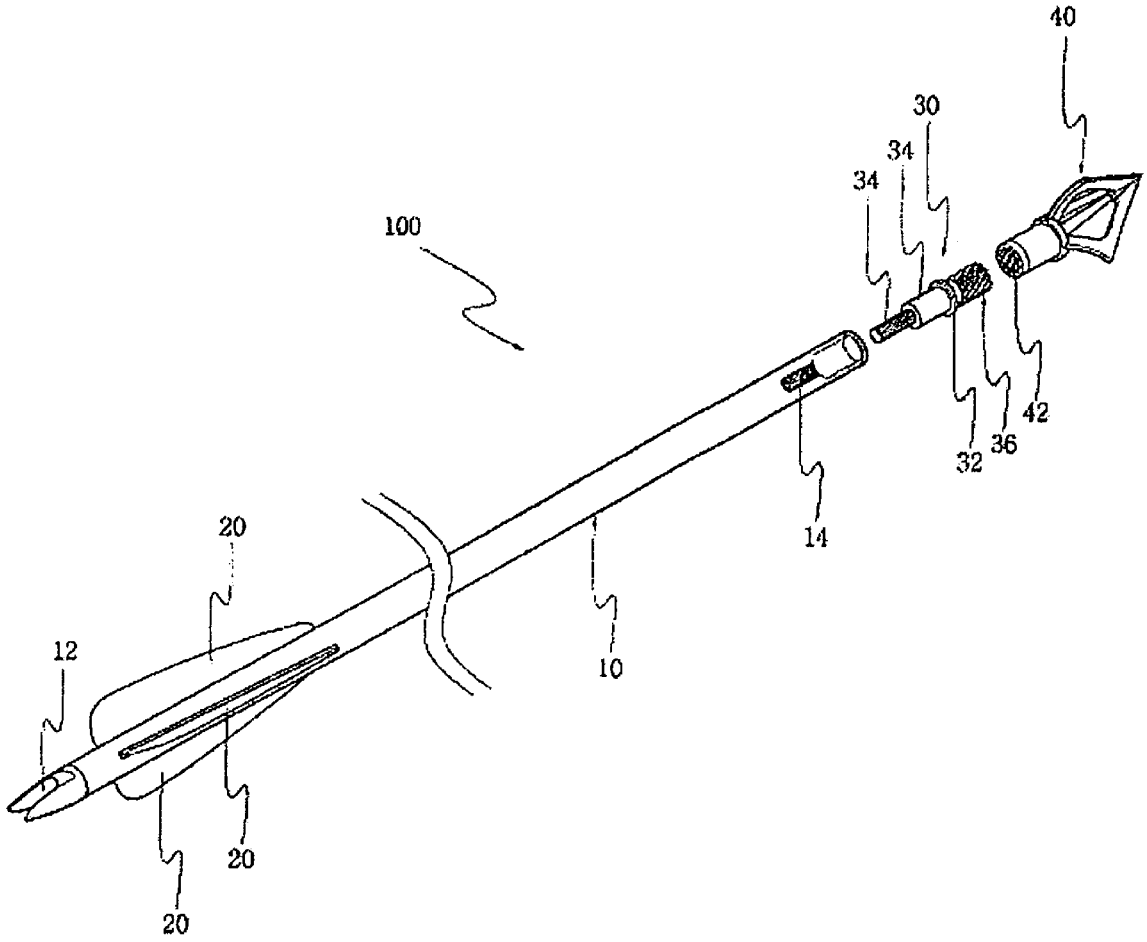
FIG. 1 is a separate perspective view showing an arrow for hunting according to a first embodiment of the present invention.
Figure 2:
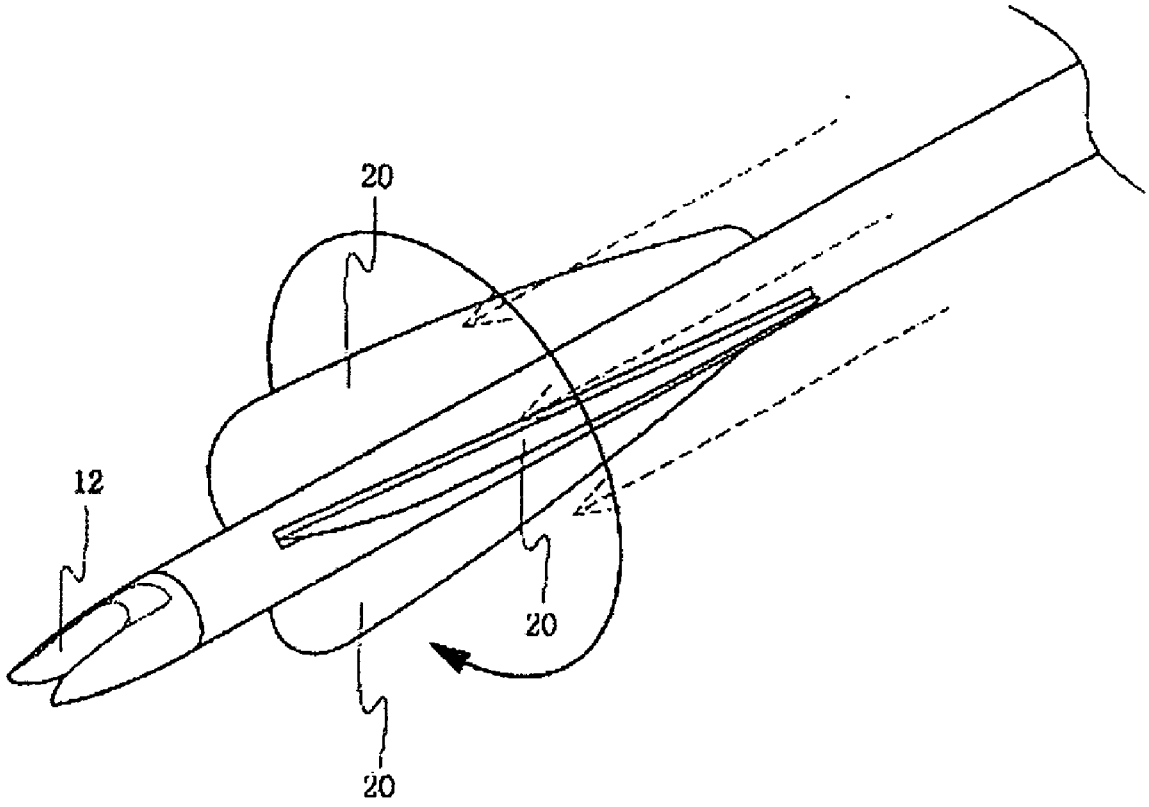
FIG. 2 is a perspective view showing wing members in the arrow for hunting of FIG. 1.
Figure 3:
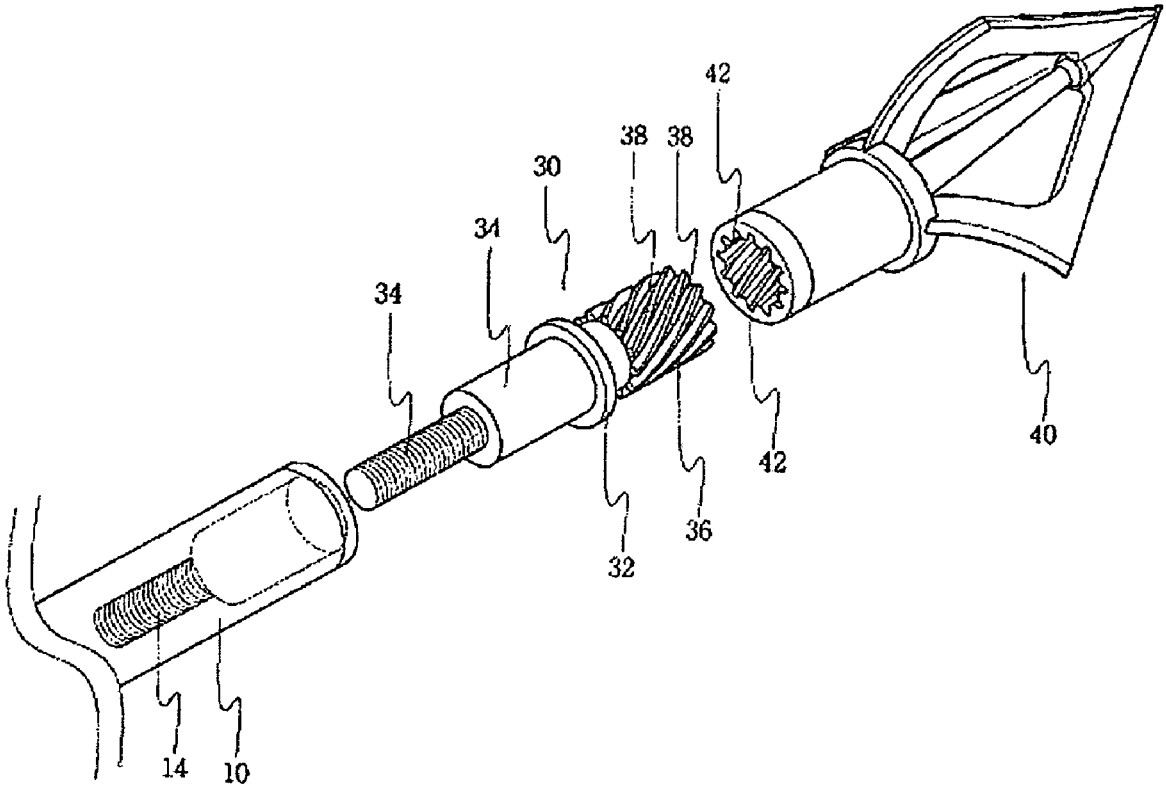
FIG. 3 is a separate perspective view showing a connecting member and an arrowhead in the arrow for hunting of FIG. 1.

FIGS. 1 to 6 show an arrow for hunting according to a first embodiment of the present invention, wherein FIG. 1 is a separate perspective view showing an arrow for hunting according to the first embodiment of the present invention, FIG. 2 is a perspective view showing wing members in the arrow for hunting of FIG. 1, FIG. 3 is a separate perspective view showing a connecting member and an arrowhead in the arrow for hunting of FIG. 1, and FIGS. 4 to 6 are perspective views showing the use states of the arrow for hunting of FIG. 1.

As shown in the figures, an arrow 100 for hunting according to the first embodiment of the present invention largely includes an arrow shaft member 10, a plurality of wing members 20, a connecting member 30, and an arrowhead 40.

As shown in FIG. 1, the arrow shaft member 10 of a predetermined length has a recess part 12 formed on one end thereof so as to insert a bowstring of a bow thereinto and an arrow shaft screw part 14 formed at the inside on the other end thereof and having a screw thread formed thereon.

The plurality of wing members 20 are mounted near the recess part 12 of the arrow shaft member 10 in such a manner as to be spaced apart by a predetermined distance from each other along the outer periphery of the arrow shaft member 10, and each wing member 20 is formed of a thin plate that is protruded from the surface of the arrow shaft member 10.

As shown in FIG. 2, the lengthwise center line in each wing member 20 is formed slantly with respect to the lengthwise center line in the arrow shaft member 10. Therefore, while the arrow shaft member 10 is flying, the thin and large plate of each wing member 20 receives air resistance to collide against air, thereby obtaining a force applied thereto. With the force applied to each wing member 20, the arrow shaft member 10 rotatably flies.

If the arrow shaft member 10 rotatably flies, the arrowhead 40 as will be discussed below is also rotated. Thus, the arrow 100 for hunting according to the present invention rotatably flies to get stuck in the body of a hunting target, such that it is easily stuck in the body of the hunting target and simultaneously completely destroys the body tissues of the hunting target, thereby making the hit target bleed much.

The connecting member 30 is adapted to be coupled to the arrow shaft member 10, which includes a round plate part 32, a connecting screw part 34, and a spiral protruding part 36.

The round plate part 32 has a generally round plate-like shape.

The connecting screw part 34 is protruded from the round plate part 32 and has a screw thread formed along the outer periphery thereof in such a manner as to be screw-coupled to the arrow shaft screw part 14.

As shown in FIG. 3, the spiral protruding part 36 is protruded from the round plate part 32 in an opposite direction to the connecting screw part 34 and has a plurality of spiral grooves 38 formed spirally along the outer periphery thereof at predetermined intervals.

The arrowhead 40 is adapted to be coupled to the connecting member 30 in the opposite direction to the arrow shaft member 10 coupled to the connecting member 30 and has a pointed shape at the end thereof in such a manner as to be adapted to be inserted into the body of the hunting target.

Also, the arrowhead 40 has a plurality of insertion protrusions 42 formed along the inner periphery of the end portion thereof in such a manner as to be inserted into the spiral grooves 38, thereby being coupled to the connecting member 30.

According to the first embodiment of the present invention, the spiral directions of the plurality of spiral grooves 38 are formed such that the arrowhead 40 is rotated in the same direction as the rotating direction of the arrow shaft member 10.

That is, as shown in FIG. 2, the arrow shaft member 10 is rotated in a clockwise direction, and as will be explained below, when the spiral protruding part 36 of the connecting member 30 is inserted into the inside of the arrowhead 40, the spiral direction of each spiral groove 38 is formed to allow the arrowhead 40 to be rotated in the clockwise direction.

Figure 4:
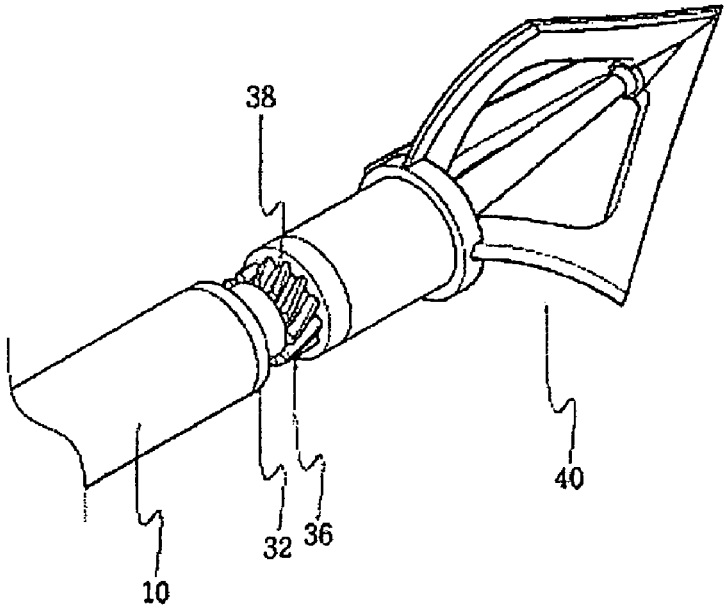
FIGS. 4 to 6 are perspective views showing the use states of the arrow for hunting of FIG. 1.

Under the above-mentioned configuration, the arrow 100 for hunting according to the first embodiment of the present invention is operated as follows:

First, as shown in FIG. 4, the arrowhead 40 is coupled to the connecting member 30, for example, in the state where the spiral grooves 38 are partially exposed, that is, the spiral grooves 38 are exposed to the outside by about 5 mm in a lengthwise direction of the arrow shaft member 10.

In this state, the bowstring of the bow is inserted into the recess part 12 and is pulled to shoot the arrow 100 for hunting of this invention at the hunting target.

After that, the arrow 100 for hunting flies, and during the flying, air resistance is applied to the thin and large plates of the wind members 20, thereby making the arrow shaft member 10 rotated, such that while the arrowhead 40 is being rotated in a counter-clockwise direction, the arrow 100 for hunting flies.

Figure 5:
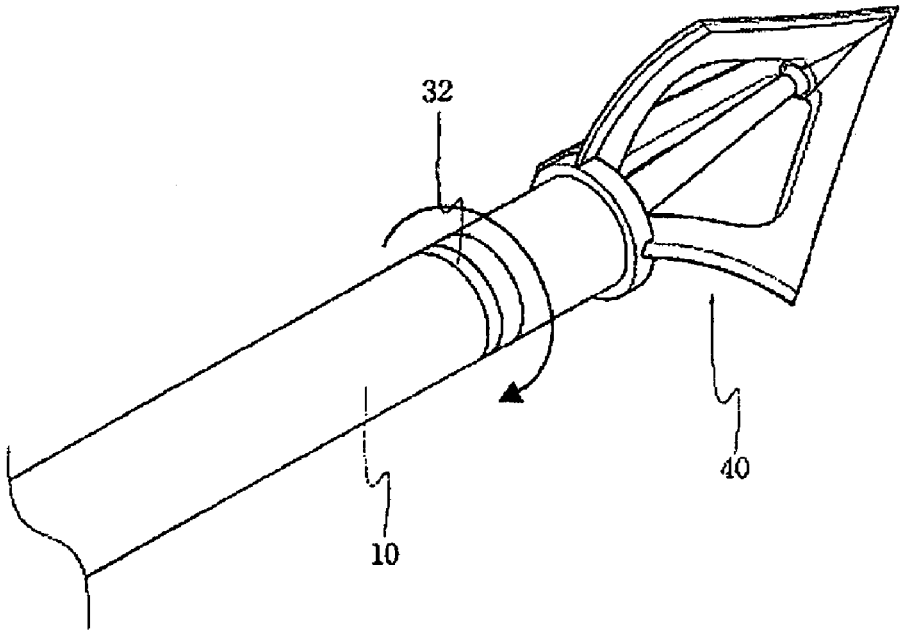
Figure 6:
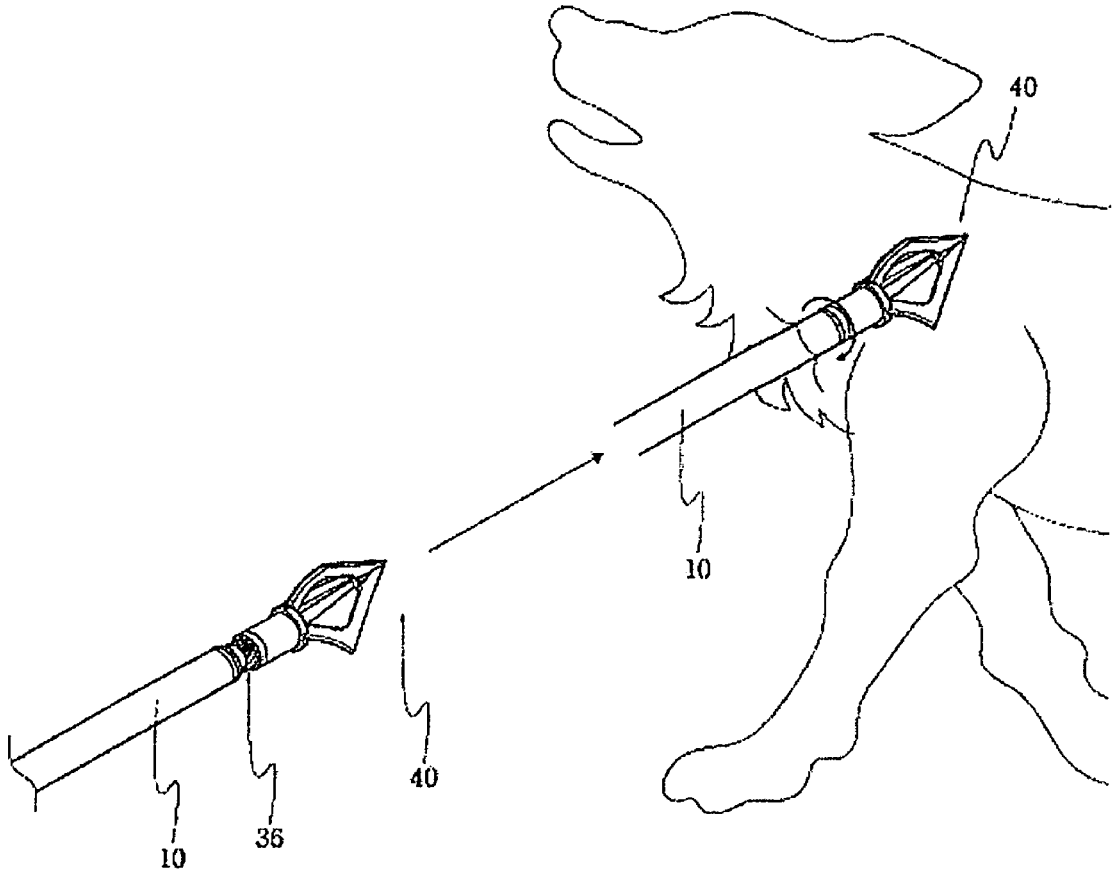

Next, when the arrow 100 for hunting hits the body of the hunting target, the arrowhead 40 and the arrow shaft member 10 obtain a force in the contacting direction to the body of the hunting target according to the inertia force possessed by an object which resists changes in motion, as shown in FIGS. 5 and 6, such that the spiral protruding part 36 of the connecting member 30 is inserted into the inside of the arrowhead 40.

At this time, the spiral grooves 38 have the spiral directions to allow the arrowhead 40 to be rotated in the clockwise direction.

That is, as the plurality of insertion protrusions 42 of the arrowhead 40 are moved along the spiral grooves 38 of the connecting member 30, the arrowhead 40 comes into almost contact with the round plate part 32 of the connecting member 30.

By the way, since the spiral grooves 38 are formed spirally, the plurality of insertion protrusions 42 are moved along the spiral grooves 38, such that the arrowhead 40 rotatably enters the body of the hunting target.

In this case, the spiral grooves 38 are formed spirally such that the arrowhead 40 is rotated in the clockwise direction to enter the body of the hunting target.

In the state where the arrow shaft member 10 flies in the clockwise direction, if the arrowhead 40 is rotated in the counter-clockwise direction at the moment where the arrow 100 for hunting hits the body of the hunting target, the hitting effect may be decreased.

Next, as the arrowhead 40 is rotated in the clockwise direction and gets stuck in the body of the hunting target, the arrowhead 40 fully destroys the body tissues of the hunting target. As a result, the hit target bleeds much and falls down, without any further movement.

Therefore, a hunter can easily capture the hit target.

Figure 7:
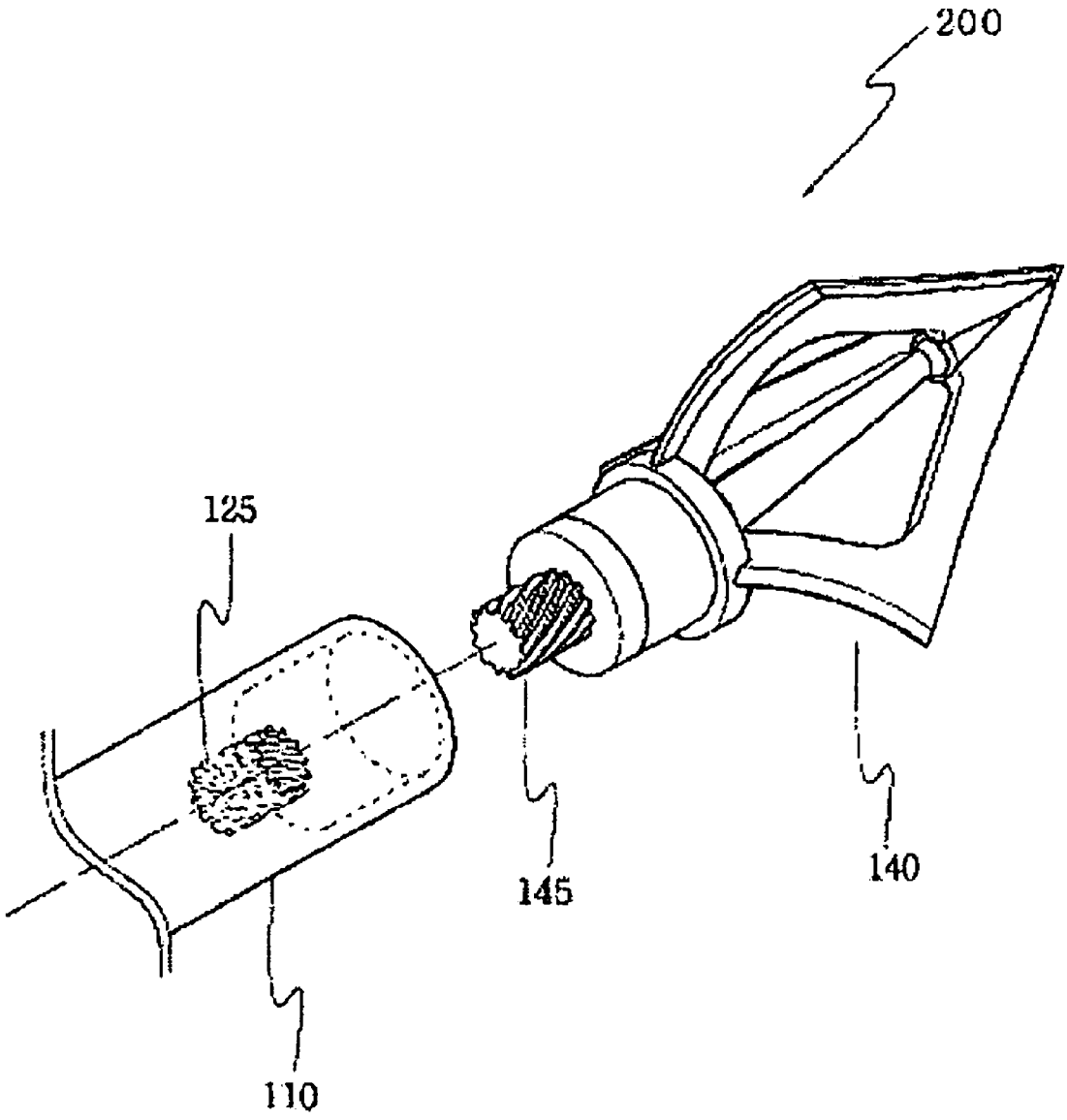
FIG. 7 is a separate perspective view showing a connecting member and an arrowhead in an arrow for hunting according to a second embodiment of the present invention.

Next, an explanation on an arrow for hunting according to a second embodiment of the present invention will be given with reference to the attached drawing. FIG. 7 is a separate perspective view showing a connecting member and an arrowhead in an arrow for hunting according to a second embodiment of the present invention.

The wing members and the recess part are not shown in FIG. 7, but it is obvious that the second embodiment of the present invention further includes the wings members and the recess part in the arrow 100 for hunting as shown in FIG. 1. Further, the same parts in an arrow 200 for hunting according to the second embodiment of the present invention as those in the arrow 200 for hunting according to the first embodiment of the present invention will be not explained for the brevity of the description.

The arrow 200 for hunting according to the second embodiment of the present invention does not need the connecting member 30 in the arrow 100 for hunting according to the first embodiment of the present invention. That is, as shown in FIG. 7, the arrow 200 for hunting according to the second embodiment of the present invention largely includes an arrow shaft member 110 and an arrowhead 140.

The arrow shaft member 110 of a predetermined length has a recess part formed on one end thereof so as to insert a bowstring of a bow thereinto and a spiral insertion protruding part 125 formed at the inside on the other end thereof.

The arrowhead 40 has a pointed shape at the end thereof in such a manner as to be adapted to be inserted into the body of the hunting target. Also, the arrowhead 40 has a spiral protruding part 145 formed along the outer periphery of the end portion protruded from the other end thereof, the spiral protruding part 145 having a plurality of spiral grooves formed thereon at predetermined intervals. The spiral protruding part 145 of the arrowhead 140 is inserted into the spiral insertion protruding part 125 of the arrow shaft member 110, thereby allowing the arrow shaft member 110 to be coupled to the arrowhead 140.

Like the arrow 100 for hunting according to the first embodiment of the present invention, the arrow 200 for hunting according to the second embodiment of the present invention has the plurality of spiral grooves formed on the spiral protruding part 145 in such a manner where the arrowhead 140 is rotated in the same direction as the rotating direction of the arrow shaft member 110.

That is, the arrow shaft member 110 is rotated in a clockwise direction, and when the spiral protruding part 145 is inserted into the inside of the arrow shaft member 110, the spiral direction of each spiral groove is formed to allow the arrowhead 140 to be rotated in the clockwise direction.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

As described above, the arrow for hunting according to the preferred embodiments of the present invention is configured wherein at the moment when the arrow hits the body of the hunting target, the arrowhead is rotated to enter the body of the hunting target, such that the hit target bleeds much and is easily captured, without any further movement.

What is claimed is:

1. An arrow for hunting comprising:

an arrow shaft member of a predetermined length having a recess part formed on one end thereof so as to insert a bowstring of a bow thereinto and an arrow shaft screw part formed at the inside on the other end thereof, the arrow shaft screw part having a screw thread formed thereon;

a plurality of wing members mounted near the recess part of the arrow shaft member in such a manner as to be spaced apart by a predetermined distance from each other along the outer periphery of the arrow shaft member, each wing member being formed of a thin plate protruded from the surface of the arrow shaft member;

a connecting member adapted to be coupled to the arrow shaft member and having a round plate part, a connecting screw part protruded from the round plate part and having a screw thread formed along the outer periphery thereof in such a manner as to be screw-coupled to the arrow shaft screw part, and a spiral protruding part formed protrudedly from the round plate part in an opposite direction to the connecting screw part and having a plurality of spiral grooves formed along the outer periphery thereof at predetermined intervals; and an arrowhead adapted to be coupled to the connecting member in the opposite direction to the arrow shaft member coupled to the connecting member and having a pointed shape at the end thereof in such a manner as to be adapted to be inserted into the body of the hunting target and a plurality of insertion protrusions formed along the inner periphery of the end portion thereof in such a manner as to be inserted into the plurality of spiral grooves.

2. The arrow for hunting according to claim 1, wherein the lengthwise center line in each wing member is formed slantly with respect to the lengthwise center line in the arrow shaft member, such that while the arrow shaft member is flying, each wing member receives air resistance to rotatably fly the arrow shaft member.

3. The arrow for hunting according to claim 2, wherein the spiral directions of the plurality of spiral grooves are formed such that the arrowhead is rotated in the same direction as the rotating direction of the arrow shaft member.

4. An arrow for hunting comprising:

an arrow shaft member of a predetermined length having a recess part formed on one end thereof so as to insert a bowstring of a bow thereinto and a spiral insertion protruding part formed at the inside on the other end thereof;

a plurality of wing members mounted near the recess part of the arrow shaft member in such a manner as to be spaced apart by a predetermined distance from each other along the outer periphery of the arrow shaft member, each wing member being formed of a thin plate protruded from the surface of the arrow shaft member; and an arrowhead having a pointed shape at the end thereof in such a manner as to be adapted to be inserted into the body of the hunting target and a spiral protruding part formed along the outer periphery of the end portion protruded from the other end thereof, the spiral protruding part having a plurality of spiral grooves formed thereon at predetermined intervals in such a manner as to be inserted into the spiral insertion protruding part of the arrow shaft member, thereby being coupled to the arrow shaft member.

5. The arrow for hunting according to claim 4, wherein the lengthwise center line in each wing member is formed slantly with respect to the lengthwise center line in the arrow shaft member, such that while the arrow shaft member is flying, each wing member receives air resistance to rotatably fly the arrow shaft member.

6. The arrow for hunting according to claim 5, wherein the spiral directions of the plurality of spiral grooves are formed such that the arrowhead is rotated in the same direction as the rotating direction of the arrow shaft member.

* * * * *